US005438396A

United States Patent [19]

Mawdesley

[11] Patent Number: 5,438,396

[45] Date of Patent: Aug. 1, 1995

[54] TONER ANTI-DRIBBLE DEVICE FOR FILL EQUIPMENT HAVING VERTICAL FILL FUNNEL AND AUGER FEEDING

[75] Inventor: Frank Mawdesley, Macedon, N.Y.

[73] Assignee: Xerox Corporation, Stamford, Conn.

[21] Appl. No.: 267,739

[22] Filed: Jun. 29, 1994

[51] Int. Cl.[6] ..... G03G 15/06

[52] U.S. Cl. ..... 355/260; 222/DIG. 1

[58] Field of Search ..... 355/245, 260; 118/653, 118/656; 222/DIG. 1

[56] References Cited

U.S. PATENT DOCUMENTS 5,345,297 9/1994 Katakabe et al. ..... 355/260

FOREIGN PATENT DOCUMENTS 61-156176 7/1986 Japan ..... 355/260

4-142571 5/1992 Japan ..... 355/260

*Primary Examiner*—William J. Royer

*Attorney, Agent, or Firm*—Oliff & Berridge

[57] ABSTRACT

A toner anti-dribble device is attachable to a toner fixture having a vertical fill tube and a rotatable auger for feeding toner into a toner cartridge. The toner anti-dribble device includes a sleeve member engageable with the fill tube. A plurality of flexible insertion wires are inserted through the sleeve member into the toner fixture and disposed substantially perpendicular to an insertion direction of the toner. The wires are preferably equally spaced about a periphery of the toner fixture and extend radially inwardly into the toner fixture preferably a distance approximately one-third a diameter of the toner fixture. The arrangement positively prevents toner dribble between fills while being flexible enough to flex in proportion to the fill rate, thereby preventing fusing of the toner on the wires.

25 Claims, 2 Drawing Sheets

TONER ANTI-DRIBBLE DEVICE FOR FILL EQUIPMENT HAVING VERTICAL FILL FUNNEL AND AUGER FEEDING

BACKGROUND OF THE INVENTION

The present invention relates to a device for preventing dribble of toner, and more particularly, to a toner anti-dribble device for use on fill equipment having a vertical fill funnel and auger feeding.

Image producing machines, such as copiers and printers, utilize toner particles that are fused to a recording medium by a heat sensitive fusing process. It has been known to use a vertical fill tube storing the toner for subsequent filling of a plastic tube or the like that ultimately communicates with the image producing device. A rotatable auger is disposed in the fill tube and is controlled by a user activated lever such as a pedal.

A problem occurs in the conventional apparatus in that toner may dribble between toner fills, resulting in a dirty operation requiring frequent cleaning of the toner fixture and lost toner.

Positive stop methods such as a slide gate across the toner flow can produce coarse particles because toner fuses at low pressures/temperatures.

Small diameter crossed wires across the mouth of the fill tube are sometimes used in toner fill operations to prevent dribbling between fills. This method, however, is not successful for some toners as the toner would fuse onto the crossed wires and shut down the operation.

SUMMARY OF THE INVENTION

Accordingly, it is an object of the invention to provide a toner anti-dribble device for use on fill equipment having a vertical funnel and auger feeding that overcomes the disadvantages of the conventional devices.

It is another object of the present invention to provide a toner anti-dribble device that effectively prevents toner dribble between fills.

These and other objects of the invention are achieved by providing a toner anti-dribble device attachable to a toner fixture having a vertical fill tube and a rotatable auger for feeding toner into a toner cartridge, the toner anti-dribble device including a plurality of flexible insertion wires inserted into the toner fixture and disposed substantially perpendicular to an insertion direction of the toner. The toner fixture may be substantially cylindrical, and the plurality of wires may extend radially inwardly into the toner fixture a distance approximately ⅓ a diameter of the substantially cylindrical toner fixture. The plurality of wires are preferably equally spaced about a periphery of the toner fixture.

Each of the plurality of insertion wires is preferably substantially U-shaped, and ends of each of the U-shaped insertion wires constitute a pair of insertion prongs, wherein the insertion prongs are disposed substantially perpendicular to the insertion direction in the device and spaced about its periphery. A collar fixed adjacent the plurality of insertion wires may be provided for fixing the plurality of insertion wires to the device.

A sleeve member that is slidingly engageable with the vertical fill tube may be provided, wherein the plurality of insertion wires extend through a corresponding plurality of insertion apertures in the sleeve member. The sleeve member may include an annular shoulder constituting a stop for the fill tube. In addition, a collar may be disposed around the sleeve member adjacent the plurality of insertion wires for fixing the plurality of insertion wires to the sleeve member.

In accordance with another aspect of the invention, a toner fixture is provided including a vertical fill tube, a rotatable auger for feeding toner into a toner cartridge, and a toner anti-dribble device for preventing toner dribble. The toner anti-dribble device includes a plurality of flexible insertion wires inserted into the toner fixture and disposed substantially perpendicular to an insertion direction of the toner.

In accordance with still another aspect of the invention, there is provided a method of preventing dribble in a toner fixture having a vertical fill tube and a rotatable auger for feeding toner into a toner cartridge, the method including the step of inserting a plurality of flexible wires into the toner fixture substantially perpendicular to a feeding direction of the toner. The inserting step may include the step of extending the plurality of wires radially inwardly into the toner fixture a distance approximately ⅓ a diameter of the substantially cylindrical toner fixture.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

Figure 1:
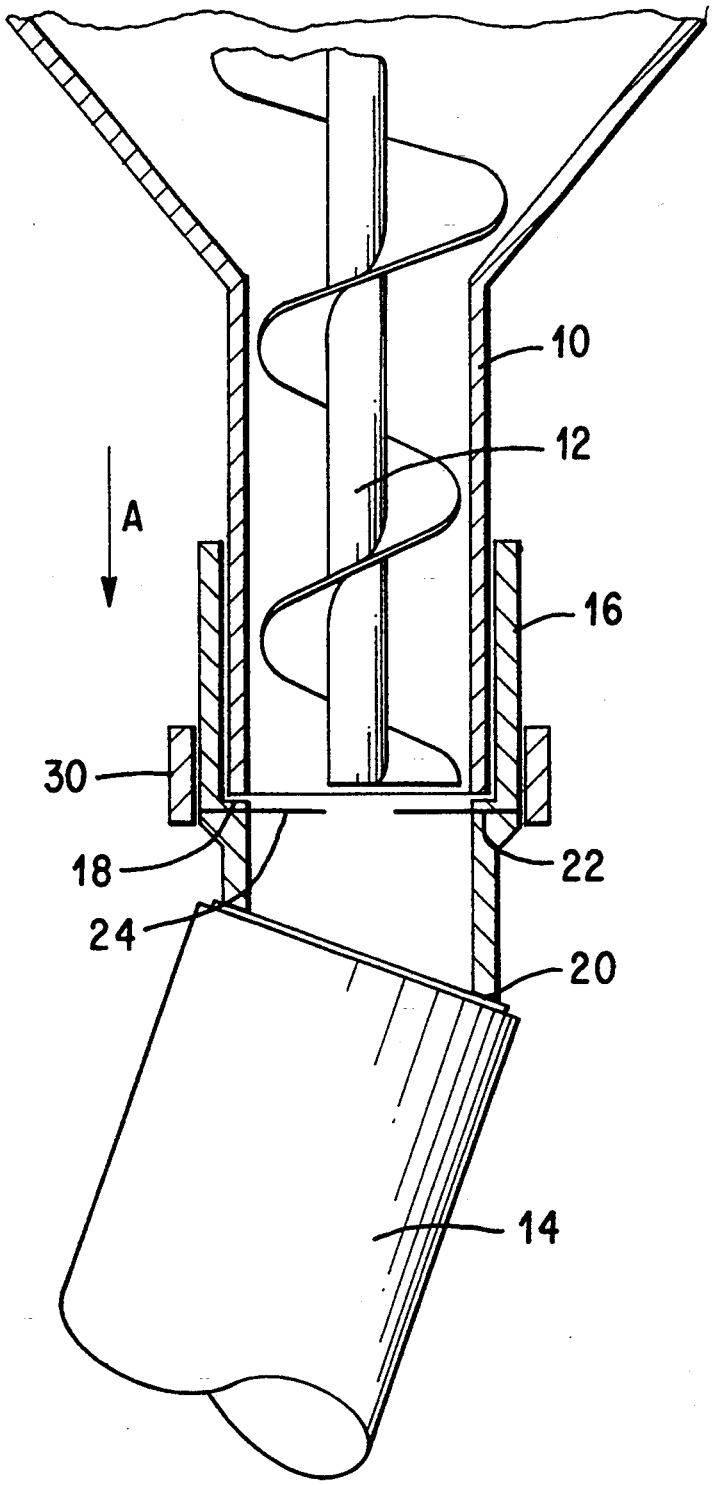
FIG. 1 is a cross-sectional view illustrating the toner antidribble device of the present invention.

Referring to FIG. 1, as discussed above, a conventional toner fixture includes a fill tube 10 with a rotatable auger 12 for feeding toner into a toner cartridge 14 that is engageable with an image producing device (not shown). The toner cartridge is placed under the fill tube and receives about 1.5 lbs. of toner. It is then removed and replaced with the next cartridge to be filled. The toner anti-dribble device in accordance with the present invention includes a sleeve member 16 engageable with a bottom portion of fill tube 10. A toner feed path is delimited by fill tube 10 and sleeve member 16. Sleeve member 16 includes an annular shoulder 18 acting as a stop for fill tube 10 as shown in FIG. 1. Sleeve member 16 is preferably secured to fill tube 10 with set screws (not shown), however, other securing means may be contemplated. A lower portion 20 of sleeve member 16 is positioned adjacent toner cartridge 14.

In the vicinity of annular shoulder 18, sleeve member 16 includes a plurality of apertures 22 for receiving a corresponding plurality of insertion prongs 24 disposed substantially perpendicular to an insertion direction of the toner (indicated by arrow A in FIG. 1). In a preferred embodiment, sleeve member 16 includes twelve apertures accommodating twelve insertion prongs 24, but the invention is not meant to be limited thereto.

The plurality of insertion prongs extend radially inwardly into the toner fixture preferably a distance approximately ⅓ a diameter of the toner fixture. This partial insertion is primarily a safety feature to avoid finger entrapment. In addition, insertion prongs 24 are preferably equally spaced about a periphery of the toner fixture.

Figure 2:
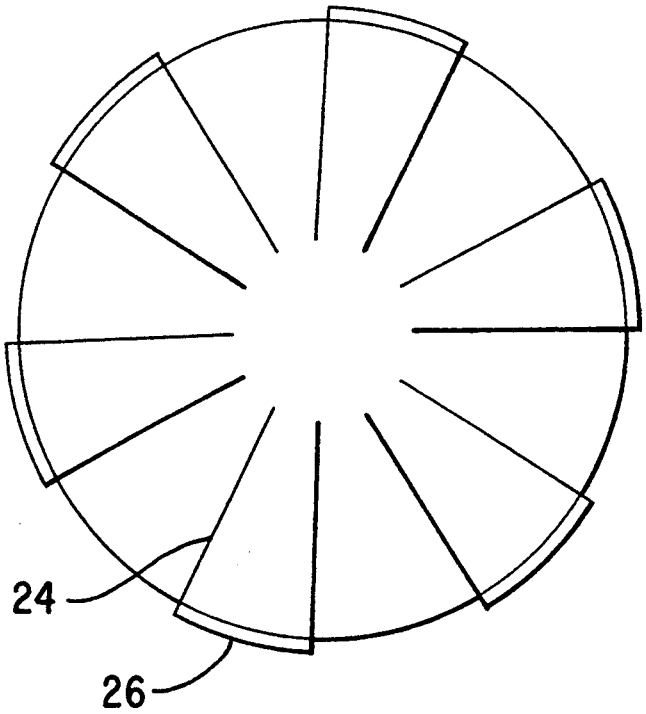
FIG. 2 is a plan view of the insertion wire arrangement.

Referring to FIG. 2, insertion prongs 24 are formed by substantially U-shaped insertion wires 26. Ends of each of the U-shaped insertion wires 26 constitute a pair of insertion prongs 24. A collar 30 (FIG. 1) is disposed annularly around sleeve member 16 adjacent insertion wires 26 for fixing insertion wires 26 to sleeve member 16. Collar 30 can be secured to sleeve member by any suitable means. In a preferred arrangement, collar 30 is secured with set screws (not shown).

Insertion wires 26 are preferably formed of 0.012 inch diameter silvered steel wire, such as E-string guitar wire. This wire is substantially stiff enough to prevent toner dribble between fills yet flexible enough to flex in proportion to the fill rate during the fill operation, thereby preventing fusing of toner on the wires due to a reduction of the normal force of toner on the wires during flow.

In a preferred embodiment, as illustrated in FIG. 2, six insertion wires 26 are inserted into the toner fixture, providing 12 insertion prongs 24. This arrangement has been found to positively prevent toner dribble between fills, however, other arrangements may be contemplated, and the invention is not meant to be limited thereto.

While the invention has been described in detail with reference to preferred embodiments thereof, which are intended to be illustrative but not limiting, various changes may be made without departing from the spirit and scope of the invention, which is defined in the following claims.

What is claimed is:

1. A toner anti-dribble device attachable to a toner fixture having a vertical fill tube and a rotatable auger for feeding toner into a toner cartridge, the toner anti-dribble device comprising a plurality of flexible insertion wires inserted into said toner fixture and disposed substantially perpendicular to an insertion direction of said toner.

2. A toner anti-dribble device according to claim 1, wherein said toner fixture is substantially cylindrical and wherein said plurality of wires extend radially inwardly into said toner fixture a distance approximately $\frac{1}{3}$ a diameter of said substantially cylindrical toner fixture.

3. A toner anti-dribble device according to claim 2, wherein said plurality of wires are equally spaced about a periphery of said toner fixture.

4. A toner anti-dribble device according to claim 1, wherein said plurality of wires are spaced about a periphery of said toner fixture.

5. A toner anti-dribble device according to claim 1, wherein each of said plurality of insertion wires is substantially U-shaped, ends of each of said U-shaped insertion wires constituting a pair of insertion prongs, wherein said insertion prongs are disposed substantially perpendicular to said insertion direction and spaced about a periphery of said toner fixture.

6. A toner anti-dribble device according to claim 5, further comprising a collar fixed to said toner fixture adjacent said plurality of insertion wires for fixing said plurality of insertion wires to said toner fixture.

7. A toner anti-dribble device according to claim 1, further comprising a collar fixed to said toner fixture adjacent said plurality of insertion wires for fixing said plurality of insertion wires to said toner fixture.

8. A toner anti-dribble device according to claim 1, further comprising a sleeve member slidingly engageable with said vertical fill tube, said plurality of insertion wires extending through a corresponding plurality of insertion apertures in said sleeve member.

9. A toner anti-dribble device according to claim 8, wherein said sleeve member comprises an annular shoulder constituting a stop for engagement with said fill tube.

10. A toner anti-dribble device according to claim 8, further comprising a collar disposed around said sleeve member adjacent said plurality of insertion wires for fixing said plurality of insertion wires to said sleeve member.

11. A toner anti-dribble device according to claim 1, wherein said plurality of insertion wires are formed of 0.012" diameter silvered steel wire.

12. A toner anti-dribble device according to claim 11, wherein said plurality of insertion wires are formed of E-string guitar wire.

13. A toner fixture comprising a vertical fill tube, a rotatable auger for feeding toner into a toner cartridge, and a toner anti-dribble device for preventing toner dribble, the toner anti-dribble device including a plurality of flexible insertion wires inserted into said toner fixture and disposed substantially perpendicular to an insertion direction of said toner.

14. A toner fixture according to claim 13, wherein said toner fixture is substantially cylindrical and wherein said plurality of wires extend radially inwardly into said toner fixture a distance approximately $\frac{1}{3}$ a diameter of said substantially cylindrical toner fixture.

15. A toner fixture according to claim 14, wherein said plurality of wires are equally spaced about a periphery of said toner fixture.

16. A toner fixture according to claim 13, wherein each of said plurality of insertion wires is substantially U-shaped, ends of each of said U-shaped insertion wires constituting a pair of insertion prongs, wherein said insertion prongs are disposed substantially perpendicular to said insertion direction and spaced about a periphery of said toner fixture.

17. A toner fixture according to claim 16, further comprising a collar fixed to said toner fixture adjacent said plurality of insertion wires for fixing said plurality of insertion wires to said toner fixture.

18. A toner fixture according to claim 13, wherein said toner anti-dribble device further comprises a sleeve member slidingly engageable with said vertical fill tube, said plurality of insertion wires extending through a corresponding plurality of insertion apertures in said sleeve member.

19. A toner fixture according to claim 18, wherein said sleeve member comprises an annular shoulder constituting a stop for engagement with said fill tube.

20. A toner fixture according to claim 18, wherein said toner anti-dribble device further comprises a collar disposed around said sleeve member adjacent said plurality of insertion wires for fixing said plurality of insertion wires to said sleeve member.

21. A toner anti-dribble device attachable to a toner fixture having a vertical fill tube and a rotatable auger for feeding toner into a toner cartridge, the toner anti-dribble device comprising a sleeve member slidingly engageable with said vertical fill tube, said sleeve member comprising a plurality of apertures disposed about a periphery of said sleeve member, wherein a plurality of flexible insertion wires are disposed in said apertures and extend into a toner feed path delimited by said fill tube and said sleeve member.

22. A method of preventing dribble in a toner fixture having a vertical fill tube and a rotatable auger for feeding toner into a toner cartridge, the method comprising the step of inserting a plurality of flexible wires into said toner fixture substantially perpendicular to a feeding direction of said toner.

23. A method according to claim 22, wherein said toner fixture is substantially cylindrical, and wherein said inserting step comprises the step of extending said plurality of wires radially inwardly into said toner fixture a distance approximately $\frac{1}{3}$ a diameter of said substantially cylindrical toner fixture.

24. A method according to claim 22, further comprising, prior to said inserting step, placing a sleeve member having a plurality of apertures disposed about its periphery over said fill tube, said inserting step comprising inserting said plurality of wires through said plurality of apertures.

25. A method according to claim 24, further comprising fixing an annular collar around said sleeve member adjacent said plurality of insertion wires, said collar securing said wires to said sleeve member.

* * * * *